US009169675B2

(12) United States Patent
Voigt et al.

(10) Patent No.: US 9,169,675 B2
(45) Date of Patent: Oct. 27, 2015

(54) CLOSURE DEVICE FOR A COMPARTMENT

(71) Applicant: Ford Global Technologies, LLC, Dearborn, MI (US)

(72) Inventors: Torsten Voigt, Cologne (DE); Simon Higgins, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/953,912

(22) Filed: Jul. 30, 2013

(65) Prior Publication Data

US 2014/0084604 A1 Mar. 27, 2014

(30) Foreign Application Priority Data

Sep. 25, 2012 (DE) ..... 10 2012 217 247

(51) Int. Cl.
*E05C 3/04* (2006.01)
*E05B 83/30* (2014.01)
*E05B 77/04* (2014.01)

(52) U.S. Cl.
CPC ..... *E05B 83/30* (2013.01); *E05B 77/04* (2013.01); *Y10T 292/1083* (2015.04)

(58) Field of Classification Search
USPC ..... 292/202, 336.3
See application file for complete search history.

(56) References Cited

U.S. PATENT DOCUMENTS

| | | | | |
|---|---|---|---|---|
| 5,782,510 | A * | 7/1998 | Gass | 292/165 |
| 6,152,501 | A * | 11/2000 | Magi et al. | 292/336.3 |
| 7,823,937 | B2 * | 11/2010 | Vitry | 292/336.3 |
| 2009/0179438 | A1 * | 7/2009 | Horton et al. | 292/336.3 |

FOREIGN PATENT DOCUMENTS

| | | | |
|---|---|---|---|
| EP | 1449991 | A2 | 8/2004 |
| JP | 2001-73620 | A * | 3/2001 |
| WO | 2005083212 | A1 | 9/2005 |

* cited by examiner

*Primary Examiner* — Mark Williams
(74) *Attorney, Agent, or Firm* — Vichit Chea; Price Heneveld LLP

(57) ABSTRACT

A closure device for a compartment, in particular a glove compartment, which is able to be closed by a flap, in motor vehicles, wherein the flap is designed to be displaceable by a force in a reversible manner between a released position and a blocked position in the direction of the action of a force, wherein the flap has a pivoting mechanism with a lock, wherein the lock is designed to be movable into the blocked position due to the action of a force and then comes into engagement with the locking element.

11 Claims, 3 Drawing Sheets

CLOSURE DEVICE FOR A COMPARTMENT

FIELD OF THE INVENTION

The invention generally relates to a closure device for a compartment, and more particularly to a latching closure device which is able to be closed by a flap or latch handle for a glove compartment in a motor vehicle.

BACKGROUND OF THE INVENTION

It is generally known that closable compartments in a motor vehicle are intended to remain securely closed in specific loading situations. Such loading situations may, for example, occur in flaps of glove compartments in motor vehicles when an air bag is installed in the same mounting part as the glove compartment and the air bag is deployed in the event of a vehicle accident or when an occupant presses the knees against the flap in the event of a crash.

Locks triggered via sensors and actuated by a motor are known and effective but complex and associated with high costs.

A closure device for a compartment which is able to be closed by a flap, in particular a glove compartment, in motor vehicles is disclosed in EP 1449991 A2. Such closure device includes a latch and a lock clip. In the aforementioned publication, the latch and the lock clip are suspended by a holder in the form of a slip clutch which is deformable or displaceable and which causes a deformation or displacement when a release energy limit is exceeded and thus prevents the opening thereof.

A locking unit for the cover of an opening in the interior of vehicles is disclosed in WO 2005/083212 A1. Such locking unit has a housing connected to the cover or to the frame defining the opening to be covered, in which a spring-loaded rocker is pivotably mounted. The rocker cooperates with a spring-loaded locking element which is additionally able to be locked in the closed position thereof and engages behind a locking element arranged on the frame of the opening or the cover to be covered. The locking element consists of two latching elements mounted mirror-symmetrically within a common pivot axis, wherein the spring acts on at least one latching element. The spring moves the latching elements into a scissors-like open position, and at least one latching element has a stop which, when brought into contact with the locking element, moves the latching elements counter to the action of a spring force into the closed position in which the latching elements grip around the locking element from both sides and in the closed position latches a locking lug arranged on the spring-loaded rocker to one of the latching elements and, for initiating the opening movement via an actuating element, the rocker is able to be moved counter to the action of the spring and moves the locking lug out of the latching position.

It would be desirable to provide a simple closure device which prevents the opening of a flap by the action of a force in the event of a crash, without a complex construction.

SUMMARY OF THE INVENTION

According to one aspect of the present invention, a closure device for a vehicle glove compartment is provided. The closure devices includes a flap configured to close the glove compartment and displaceable by a force in a reversible manner between a released position and a blocked position in a direction of action of the force. The flap includes a pivoting mechanism with a lock movable into the blocked position due to action of the force and then into engagement with a locking element.

According to another aspect of the present invention, a closure device for a vehicle compartment is provided. The closure devices includes a flap configured to close the compartment and including a pivoting mechanism with a lock designed to be movable into a blocked position due to action of a force and then into engagement with a locking element. The flap closes the compartment and is displaceable by the force in a reversible manner between a released position and the blocked position in a direction of action of the force.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
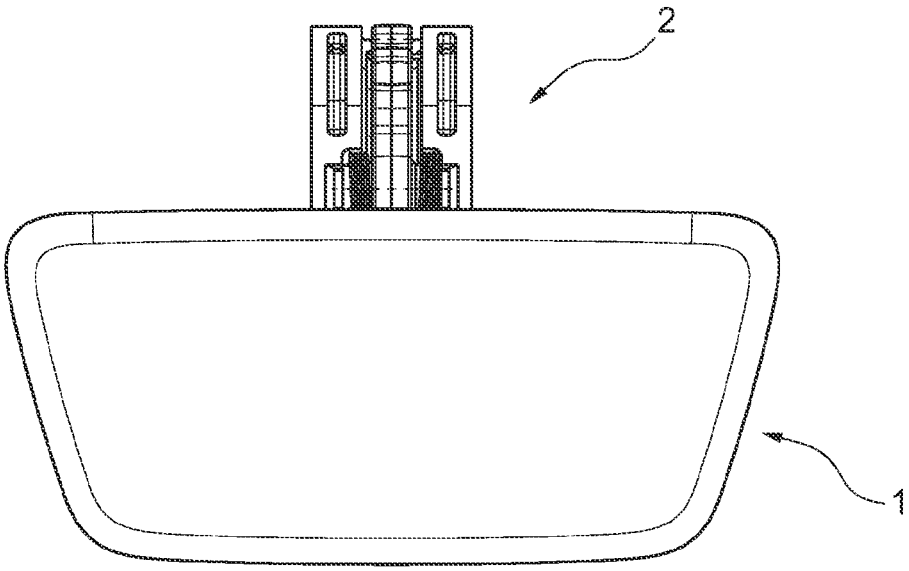
FIG. 1 is a front side view of a latch handle flap including the pivoting mechanism of a glove compartment of a passenger motor vehicle.
Figure 2:
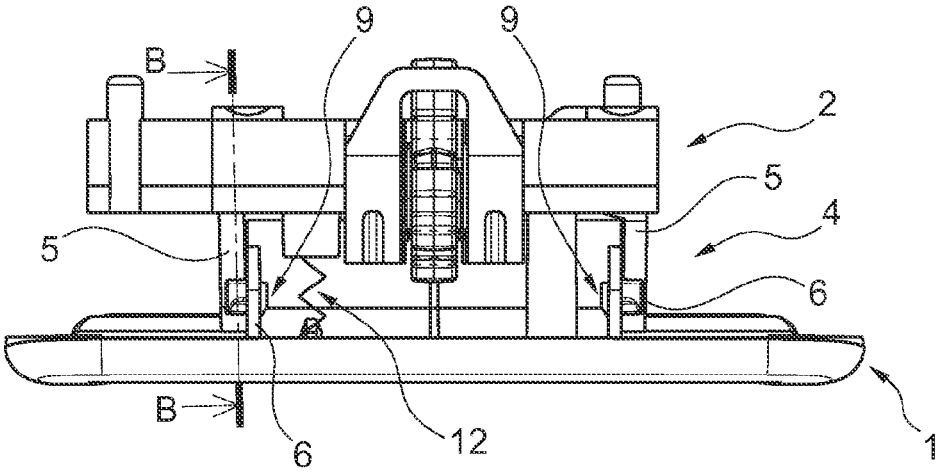
FIG. 2 is a plan view of the flap of FIG. 1.
Figure 3:
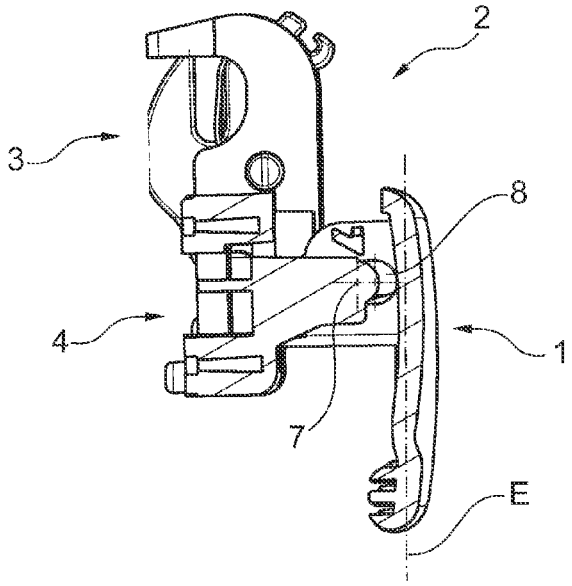
FIG. 3 is a sectional side view of the flap of FIG. 2 taken along line B-B illustrating the flap in the closed position.

As required, detailed embodiments of the present invention are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

A closure device for a storage compartment such as the glove compartment in the passenger compartment of a vehicle is disclosed herein. The closure device includes a flap that functions as a latch handle to pivot open due to force applied by a user to unlatch a latch and allow the compartment door or lid to open to gain access to the compartment. The flap is designed to be displaceable by a force in a reversible manner between a released position and a blocked position in the direction of the action of a force, wherein the flap has a pivoting mechanism with a lock, wherein the lock is designed to be movable into the blocked position due to the action of a force and then comes into engagement with a locking element. Thus, the force acting on the flap in the event of a crash may be used in a simple manner to lock the flap. In other words, the flap is displaced by the action of a force, for example a force applied by a passenger's knee, from a released position in which it may be opened into a locked or blocked position in which it is not able to be opened and/or does not open. In the locked position, the lock cooperates with a corresponding locking element.

Preferably, the lock is configured to move into the blocked position when a force acts perpendicular to the flap plane. In particular, the lock includes the flap which is designed to be displaceable relative to the fixed pivot axis of the pivoting mechanism, wherein the flap is moved into the blocked position when a force acts perpendicular to the flap plane, so that the flap and/or pivot axis itself forms part of the lock and further components, apart from the locking element, are not required. In order to permit a simple displacement, the pivot axis is arranged in a slot.

As soon as the flap has been displaced, therefore, relative to the pivot axis thereof in the slot by the action of a force, the locking element comes into effect. In one embodiment, the locking element is a latching lug which penetrates a corresponding recess of the pivoting mechanism and prevents the rotation of the flap about the axis.

The flap may be pretensioned by a spring in the slot in the direction of the released position so that it is normally located in this position and/or is automatically unlocked after the crash or when the action of a force ceases.

A latch handle flap of a glove compartment of a passenger motor vehicle is shown in FIG. 1-5 and denoted as a whole by reference identifier 1. The flap 1 is fastened via a pivoting mechanism 2 to the vehicle dashboard, according to one embodiment, and is pivotable between a closed position shown in FIG. 3 and an open position shown in FIG. 5.

The pivoting mechanism 2 includes a retaining part 3 and a pivoting part 4. The retaining part 3 retains the flap 1 onto the compartment. The pivoting part 4 includes two protruding holders 5 spaced apart from one another, on which the latch handle flap 1 with correspondingly spaced-apart counter-holders 6 is rotatably fastened to the rear face of the flap 1. To form the pivot axis 7, the holders 5 include two inwardly protruding pins 9 which in each case engage in a slot 8 formed in the counter-holders 6.

Figure 5:
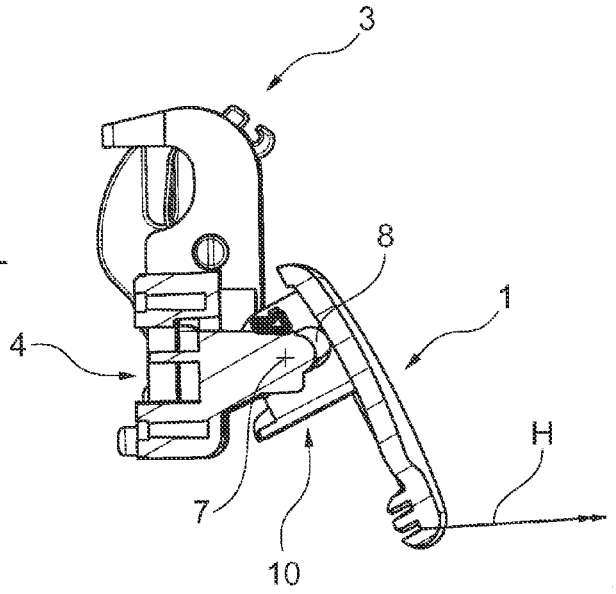
FIG. 5 is a view corresponding to FIG. 3 illustrating the flap in the open position during normal operation.

With the action of a lever force H on the lower edge of the flap 1 as shown in FIG. 5 the flap 1 is thus able to be pivoted about the pivot axis 7 for the opening thereof. This corresponds to a normal operation and/or situation for unlatching and opening the compartment closure.

Figure 4:
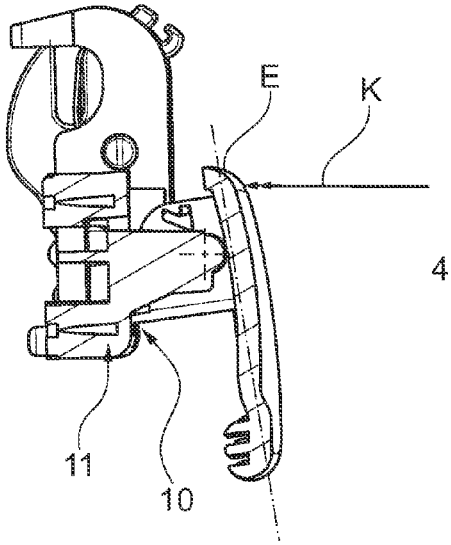
FIG. 4 is a view corresponding to FIG. 3 with the action of a force.

If, as shown in FIG. 4, a force K acts approximately perpendicular to the flap plane E, the flap 1 is displaced relative to the pins 9 in the slot 8, in the direction of the action of the force K, so that the pivot axis 7 of the flap is displaced. In this case, a latching lug 10 which serves as a locking element penetrates a corresponding recess 11 of the pivoting part 4 and thus prevents a pivoting of the flap 1 about the pivot axis 7.

So that the translatory displacement of the flap 1 relative to the pivoting part 4 does not take place and/or is prevented in normal use, a compression spring 12 (see FIG. 2) is provided. The compression spring 12 pretensions the flap 1 in the slots 8 relative to the pins 9 (counter to the direction of the action of a force K). This also permits the return of the flap 1 from the displaced position shown in FIG. 4 into the normal position shown in FIG. 5 when the action of a force K ceases.

Figure 6:
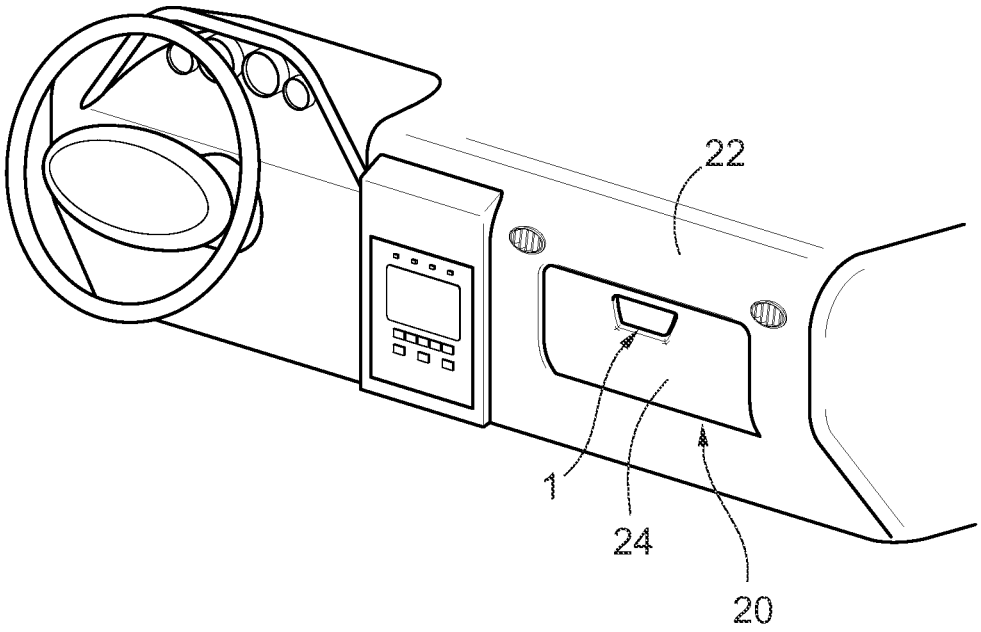
FIG. 6 is a perspective view of a vehicle glove compartment employing the flap as a latch handle.

The latch handle flap 1 is further shown in FIG. 6 installed on a glove compartment 20 located in the vehicle dashboard 22 at the front of the passenger compartment. The flap 1 is assembled to closure door 24 that pivots between closed and open positions to allow access to the compartment 20. Activation of the flap 1 by a user applying a pulling force H unlatches the locking device to open the door 24, while undesired pulling forces K are prevented from opening the door 24.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A closure device for a vehicle glove compartment, said closure device comprising:

a flap that functions as a latch handle and configured to pivot to an open position and pivot to a closed position of the glove compartment, the flap displaceable to a blocked position by a first force acting on an outer surface of the flap in a first direction, wherein the flap comprises a pivoting mechanism with a lock, the flap movable by the first force to the blocked position where the lock is moved into engagement with a locking element to prevent pivoting of the flap and thereby lock the flap in the blocked position, wherein when the first force is removed from acting on the outer surface, said flap is displaceable to a released position by a second force acting in a second direction opposite to the first direction, in which when the flap is in the released position the flap may pivot from the released position to the open position or to the closed position, and wherein a spring provides the second force that biases the flap in the second direction.

2. The closure device as claimed in claim 1, wherein the lock is configured to move into the blocked position when the first force acts perpendicular to a flap plane.

3. The closure device as claimed in claim 2, wherein the lock is designed to be displaceable relative to a fixed pivot axis of the pivoting mechanism.

4. The closure device as claimed in claim 3, wherein the pivot axis is arranged in a slot.

5. The closure device as claimed in claim 4, wherein the flap is pretensioned by the spring in the second direction towards the released position in the slot.

6. The closure device as claimed in claim 1, wherein the locking element comprises a latching lug configured to penetrate a recess of the pivoting mechanism in the blocked position.

7. A closure device for a vehicle compartment, said closure device comprising:

a flap that functions as a latch handle and configured to pivot to open and to close the compartment, the flap comprising a pivoting mechanism with a lock movable into a blocked position and into engagement with a blocking element to prevent pivoting of the flap and thereby lock the flap, the flap moving into the blocked position due to a first force acting on an outer surface of the flap in a first direction, wherein when the first force is removed from acting on the outer surface, the flap is displaceable by a second force acting in a second opposite direction opposite to the first direction to a released position in which the flap may pivot to open or close the compartment, wherein the pivoting mechanism has a pivot axis arranged in a slot, and the pivot axis moves in the slot in the first direction when the flap moves to the blocked position and the pivot axis moves in the slot in the second direction when the flap moves to the released position.

8. The closure device as claimed in claim 7, wherein the lock is configured to move into the blocked position when the first force acts perpendicular to a flap plane.

9. The closure device as claimed in claim 8, wherein the lock is designed to be displaceable relative to a fixed pivot axis of the pivoting mechanism.

10. The closure device as claimed in claim 9, wherein the flap is pretensioned by a spring in the direction of the released position in the slot.

11. The closure device as claimed in claim 7, wherein the locking element comprises a latching lug configured to penetrate a recess of the pivoting mechanism in the blocked position.

* * * * *